US007121271B1

(12) United States Patent
Arndt

(10) Patent No.: US 7,121,271 B1
(45) Date of Patent: Oct. 17, 2006

(54) ANTI-PINCH BOLT

(76) Inventor: Joseph R Arndt, 15611 Split Creek Dr., Monument, CO (US) 80132

( * ) Notice: Subject to any disclaimer, the term of this patent is extended or adjusted under 35 U.S.C. 154(b) by 59 days.

(21) Appl. No.: 10/386,627

(22) Filed: Mar. 12, 2003

Related U.S. Application Data

(60) Provisional application No. 60/364,345, filed on Mar. 12, 2002.

(51) Int. Cl.
*F41B 11/02* (2006.01)

(52) U.S. Cl. ..... 124/71

(58) Field of Classification Search ..... 124/71–76; 42/69.02
See application file for complete search history.

(56) References Cited

U.S. PATENT DOCUMENTS

| | | | | | |
|---|---|---|---|---|---|
| 3,580,132 | A | | 5/1971 | Vartanian | |
| 3,621,536 | A | * | 11/1971 | Remmery | 425/161 |
| 3,835,566 | A | * | 9/1974 | Bielfeldt et al. | 42/16 |
| 3,889,574 | A | * | 6/1975 | Sanford | 89/169 |
| 3,964,366 | A | * | 6/1976 | Atchisson | 89/148 |
| 4,058,922 | A | * | 11/1977 | Elbe et al. | 42/16 |
| 4,556,217 | A | * | 12/1985 | Kochan | 482/128 |
| 5,014,595 | A | * | 5/1991 | Ducolon, Jr. | 89/44.01 |
| 5,344,170 | A | * | 9/1994 | Ochoa | 280/283 |
| 5,411,487 | A | * | 5/1995 | Castagna | 604/198 |
| 5,782,118 | A | * | 7/1998 | Chamberlain et al. | 70/278.3 |
| 5,908,024 | A | | 6/1999 | Staev | |
| 6,142,136 | A | * | 11/2000 | Velasco | 124/71 |
| 6,179,302 | B1 | * | 1/2001 | Gauthier et al. | 279/75 |
| 6,260,866 | B1 | * | 7/2001 | Cheng | 280/87.05 |
| 6,371,099 | B1 | | 4/2002 | Lee | |
| 6,715,399 | B1 | | 4/2004 | Barrett | |
| 2003/0067176 | A1 | * | 4/2003 | Stevens et al. | 292/339 |
| 2003/0168053 | A1 | | 9/2003 | Farrell | |
| 2004/0074486 | A1 | | 4/2004 | Schavone | |
| 2004/0089280 | A1 | | 5/2004 | Kunimoto | |

FOREIGN PATENT DOCUMENTS

FR 2759735 A1 * 8/1998

OTHER PUBLICATIONS

Pan Am Las Vegas 2002 Vendor Display Photo Gallery (WARPIG.com), Bill Mills, date unknown.*

* cited by examiner

*Primary Examiner*—Troy Chambers
(74) *Attorney, Agent, or Firm*—Colin P. Abrahams

(57) ABSTRACT

An anti-pinch bolt is provided for use with a paintball marker having an automatic reloading mechanism comprising an instrument connected to the bolt by a pin for moving the bolt between a loading and a loaded position. The bolt comprises a tubular bolt body having a front end, a rear end and a slot for receiving the pin. A spring is provided for maintaining, in use, the pin in a first position in the slot, the spring allowing movement of the pin toward a second position in the slot when the bolt is obstructed by the presence of a paintball.

22 Claims, 4 Drawing Sheets

ANTI-PINCH BOLT

CROSS REFERENCE TO RELATED APPLICATIONS

This application claims the benefit of U.S. Provisional Application No. 60/364,345 filed Mar. 12, 2002, which is incorporated herein by reference in its entirety.

FIELD AND BACKGROUND OF THE INVENTION

This invention relates to an anti-pinch bolt, particularly one for use with paintball markers.

The game of paintball is a growing form of sport and entertainment, and comprises a paintball marker, or a paintball gun, which fires substantially spherical paintballs having an outer skin and a volume of paint contained within. The paintball is fired from the paintball marker by the user, and, upon striking its target, the paintball's outer skin ruptures or bursts, releasing the paint.

Over the years, paintball markers have become increasingly more sophisticated, and comprise automatic mechanisms for firing the paintball from the breech, and immediately thereafter cocking the paintball marker so that a new paintball, from an attached magazine, drops into the breech for subsequent firing. These actions are achieved, in some paintball markers, by a dual action trigger mechanism, coupled with pneumatic airflow within the paintball marker appropriately controlled by valves depending upon the cycle.

In certain paintball markers, the initial pulling of the trigger results in the release of a hammer, which has the effect of opening pneumatic pathways so that air under great pressure enters the breech and expels the paintball from the paintball marker. Further action on the trigger activates the pneumatic system and the three-way valve so as to activate a back block and bolt in combination to move in a manner which permits entry of the next paintball from the magazine into the breech. Therefore, upon completion of this cycle, when the trigger is pulled again, the paintball marker is ready to fire the next paintball without any manual cocking or loading being necessary.

The loading of the paintball by permitting it to drop from a magazine into the breech is typically accomplished in many paintball markers by the rearward movement of a bolt, which is moved by a back block attached thereto. The back block itself is activated by the pneumatics of the paintball marker. Thus, the bolt moves backward so as to open feed port from the magazine into the breech and allow the paintball to drop in. Thereafter, the bolt moves forward to close off the opening, which is necessary, otherwise the forced air in the pneumatic system, upon firing of the weapon, will not provide the necessary thrust for the paintball. One problem which often occurs in conventional paintball markers in the loading of the paintball is that the bolt may move forward before the paintball has had an opportunity to drop completely into the breech. If this should occur, the bolt will rupture the paintball within the breech, causing the liquid within the paintball to fill the inside of the marker. This causes significant problems and delays, including the fact that the wet barrel makes the marker extremely inaccurate. All of the paint liquid and residue must be removed, a time-consuming operation, in order for the marker to continue to function normally.

It is therefor an aspect of the present invention to provide a bolt preferably for use in a paintball marker, which is configured so that it will not rupture a paintball which has been only partially loaded in the breech.

SUMMARY OF THE INVENTION

According to one aspect of the invention, there is provided an anti-pinch bolt for use with a paintball marker having an automatic reloading mechanism comprising an instrument connected to the bolt by a pin for moving the bolt between a loading and a loaded position, the bolt comprising: a tubular bolt body having a front end, a rear end and a slot for receiving the pin; and biasing means for maintaining, in use, the pin in a first position in the slot, the biasing means allowing movement of the pin toward a second position in the slot when the bolt is obstructed by the presence of a paintball.

The present invention relates to an anti-pinch bolt for use in paintball markers having automatic cocking systems for loading paintballs into the breech of the marker. In conventional systems, the bolt of the marker, which controls the loading of the paintball, moves back and forth within the breech or barrel, and is moved by a back block or some other mechanism. The back block or such other mechanism itself may be operated by biasing means and pneumatic pressure, and is moved axially with respect to the paintball marker. The back block and bolt are rigidly fixed together, usually by a push-pin or other bolt mechanism, and moved together in unison. Thus, when the back block moves rearwardly, the bolt moves rearwardly by a like distance, and when the back block moves forwards, the bolt moves forward in the same direction. In conventional markers, the bolt is not capable of independent movement relative to the back block by virtue of the rigid connection between these two components.

It should be noted that some paintball markers may not have a back block. However, such markers will typically have the push-pin connected to the bolt. It is not material to the invention how the push-pin is moved, whether by a back block or other mechanism. The invention is intended to cover a bolt of the type described herein, however it may be moved. For the sake of convenience, this specification will generally refer to a back block, but is not to be limited to such a configuration.

In accordance with one aspect of the present invention, the anti-pinch bolt of the invention is connected to the back block in a non-rigid or flexible manner, such that the back block is able to move relative to the bolt when the bolt detects an obstacle in its pathway in the form of a paintball. When such obstacle has been detected, the back block will continue to move in response to the pneumatic pressures of the paintball marker, but the bolt will be capable of remaining stationary as long as the obstacle, namely, the paintball, is blocking its movement.

It will be appreciated that, in the normal course, the paintball drops in front of the bolt. The subsequent forward movement of the bolt moves the paintball forward as well, but in this case, the paintball is not an obstacle. The paintball only becomes an obstacle when it has not fully exited the magazine, or feed port, so that it becomes lodged or stuck between the wall of the feed port, and the front end or face of the bolt.

In accordance with a preferred embodiment of the invention, the back block connects to the bolt by a pin which passes through a slot, rather than a hole, in the bolt. In normal conditions, the pin connecting the back block and the bolt will remain in a constant position, being biased thereto, but the pin will be able to move within the slot where an obstacle (in the form of a paintball), as described above, impedes the forward progress or movement of the bolt.

DETAILED DESCRIPTION OF THE INVENTION

Figure 1:
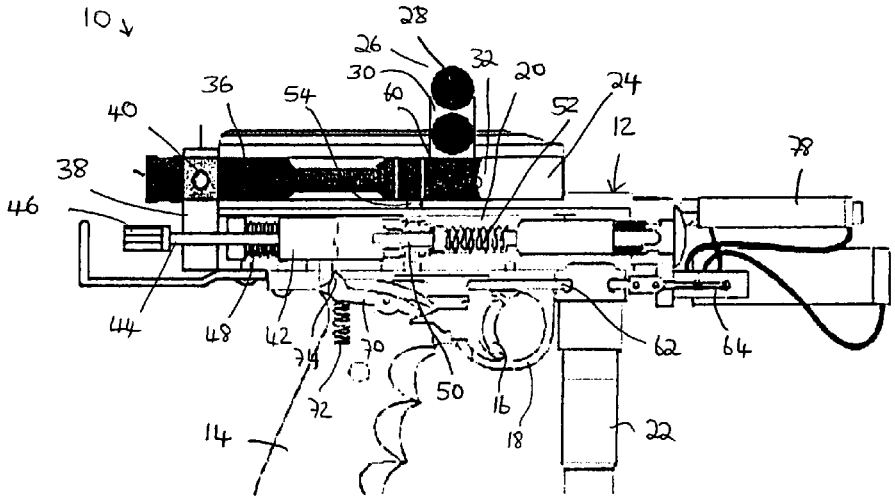
FIG. 1 (PRIOR ART)
FIG. 1 is a side view, partially in section, of a conventional paintball marker, showing a prior art bolt, with the bolt in a first position.

The present invention is for an anti-pinch bolt which is, within certain parameters, movable independently with respect to the back block to which it is attached, and by which it is moved in the normal course of a paintball marker firing cycle in order to effect loading of a paintball within the breech, subsequent to the firing of a previous paintball therefrom.

In the normal course, the anti-pinch bolt of the invention, which is coupled to a back block, will move substantially in unison with the back block, so that when the back block moves in a rearward direction, the bolt will move in the same direction for the same distance, and, conversely, when the back block moves in a forward direction, the bolt will move in the same direction for a substantially similar distance. The back block itself is operated by the pneumatics of the paintball marker.

The invention does, however, provide a flexible linkage or coupling between the anti-pinch bolt of the invention and the back block so that, under certain circumstances, the forward movement of the back block will not force concomitant movement of the bolt. This situation most typically arises when a paintball has not fully dropped within the breech, and is lodged as an obstacle partially exited from the feed port of the paintball magazine, and only partially fallen into the breech.

The Figures show the use of an anti-pinch bolt of the invention with a paintball marker with an automatic cocking system wherein a firing cycle not only fires a first paintball, but also reloads a second paintball for subsequent firing. It will be appreciated that the anti-pinch bolt of the invention can be used with any appropriate paint ball marker, and not necessarily the one of the type shown in the drawings. Thus, the anti-pinch bolt of the invention may have the flexible movement capabilities when used with any type of paintball marker.

The paintball marker shown in the accompanying Figures has a large number of components and operations, many of which are not relevant to the present invention. Therefore, only a broad description of some of the relevant components of the paintball marker will be provided herein, so that a full understanding of the operation and effect of the anti-pinch bolt of the invention can be appreciated.

Turning to FIG. 1 of the drawings, there is shown a conventional paintball marker, having an automatic reloading or cocking system. The paintball marker includes a body 12, a handle 14 and a trigger 16 in a trigger guard 18. The body 12 defines a chamber 20 with various components, to be described, and a pneumatic power source 22. Above the body 12 on the paintball marker 10, there is a location for a barrel 24 and a paintball magazine 26 containing a plurality of paintballs 28 which pass through a feed port 30 of the magazine 26 into the breech 32 of the barrel location 24. Within the barrel location 24, there is located a bolt 36, connected to a back block 38. As will be described, the bolt 36 reciprocates forwardly and rearwardly within the body 12, moved by the back block 38. The back block 38 and bolt 36 are connected in a fixed, non-flexible manner by means of a push-pin 40.

Within the chamber 20 of the paintball marker 10, there is located a firing hammer 42, which includes a piston rod 44 which extends externally of the chamber 20, and ends in a knob 46. The firing hammer 42 is urged forwardly by spring 48.

A valve 50 is located within the chamber 20. The valve 50 is normally urged into the closed position by spring 52. An aperture 54 is formed between the chamber 20 and the barrel 24 so that, when the pneumatic pathways are open, as will be described, forced air enters the barrel 24 via holes (not shown) in the bolt 36. The air entering the bolt 36 through the holes is then forced through a hole in the front face 60, the force of which expels a paintball 28, located in front of the front face 60.

A rod 62 is connected to the trigger 16, and operates a three-way valve 64 which sets and varies the pneumatic flow paths within the paintball marker 10. The precise flow paths, and the action of the three-way valve, will not be discussed herein. Only a general reference thereto will be made, insofar as the flow paths affect the operation and function of the anti-pinch bolt 36.

A brief description of the firing operation will now be provided. The trigger 16 is attached to a pivotal lever 70. As the trigger 16 is puller rearwardly, the lever 70 pivots in an counter-clockwise motion, against the action of spring 72, so that the projection 74 is lowered and the firing hammer can move forward due to the action of the spring 48. The forward movement of the firing hammer 42 causes it to strike the valve 50 with a force sufficient to overcome that of the spring 52. This causes the valve 50 to open, so that a pneumatic air path is opened from the pneumatic power source 22, through the chamber 20, into the aperture 54, and out through the aperture in the front face 60 of the bolt 36. This causes the paintball in front of the front face 60 to be expelled from the paintball marker 10. It is to be noted that, upon initial firing, the bolt 36 is in the forward position, closing off the feed port 30.

Figure 2:
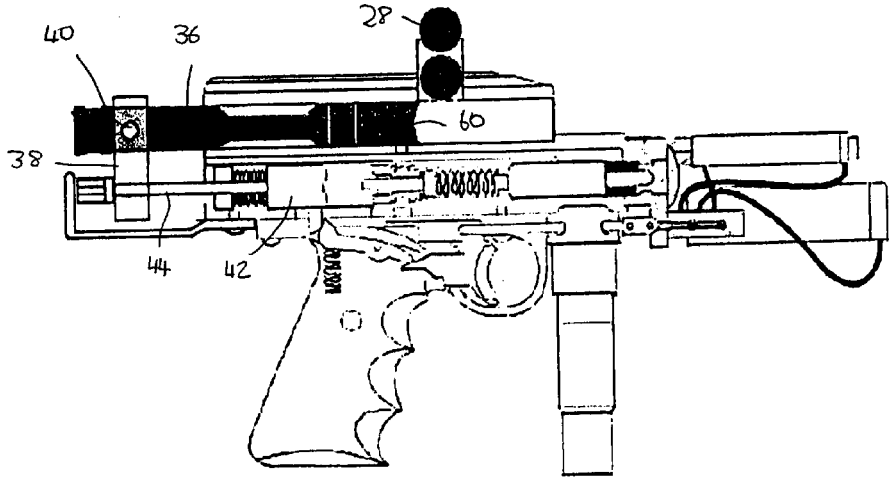
FIG. 2 (PRIOR ART)
FIG. 2 is a side view partially in section, of a conventional paintball marker as shown in FIG. 1, with the bolt moved rearwardly into a second position.

Further pulling on the trigger 16 causes the rod 62 to move axially, to thereby alter the pneumatic flow paths within the paint ball marker 10. One such effect of the rearranged pneumatic flow paths is to cause a ram 78, and associated components, to force back the back block 38 and, with it, the bolt 36 to which it is attached by the push-pin 40. When the back block 38 and bolt 36 have been moved back sufficiently, as shown in FIG. 2 of the drawings, a paint ball 28 stored in the magazine 26, can drop into the breech 32 from the feed port 30. The pneumatic pathways thereafter result in the forward movement of the back block 38, and the bolt 36 to which it is attached, so that the feed-port 30 will be closed off, and a newly loaded paint ball 28 will be located in front of the front face 60 of the bolt 36.

Figure 3:
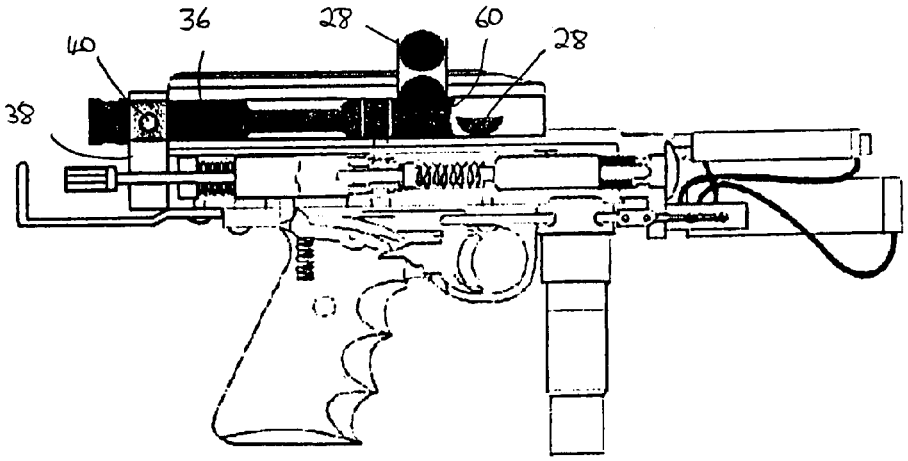
FIG. 3 (PRIOR ART)
FIG. 3 is a side view partially in section, of a conventional paintball marker shown in FIG. 1, with the bolt moving forward with a paintball only partially loaded.

While a smooth reloading will take place much of the time, there are situations where the bolt 36 will move forward in the body 12 before the paintball 28 has fully dropped into the breech 32. This situation is shown in FIG. 3 of the drawings. When this occurs, the force of the forwardly moving bolt 36 simply ruptures the paintball 28, causing a liquid spill. As previously mentioned, before the paintball marker 10 can be used once more, the liquid must be fully removed, and the barrel 24 completely cleaned, in order to ensure smooth operation and accuracy of the paintball marker.

A bolt 36 of the type shown in FIGS. 1 to 3 of the drawings contains no mechanism for stopping its forward movement when a paintball is lodged partially in the body and partially in the feed port. The back block 38 moves forwardly irrespective of any obstacle within its path, assuming that the obstacle is insufficient to stop both the forward movement of the bolt 36 and the back block 38. Normally, the mere presence of a thin-skinned, flexible paintball is insufficient to stop this operation.

One of the reasons for this inability to discontinue forward movement of the bolt 36 lies in the fact that the bolt 36 in the paintball marker as shown in FIGS. 1 to 3 of the drawings is rigidly and inflexibly connected to the back block 38. When the back block 38 moves, the bolt 36 must move in a similar manner.

Figure 4:
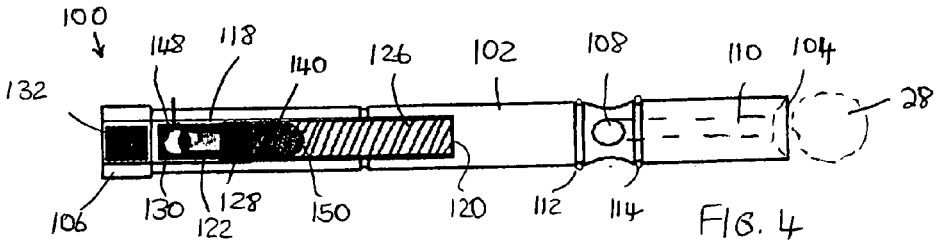
FIG. 4 is a view of an anti-pinch bolt of the invention, partly in section to show the components thereof.
Figure 5:
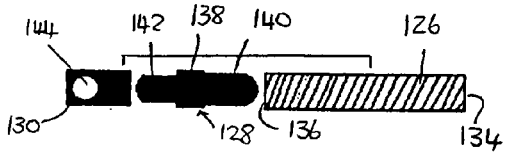
FIG. 5 is an exploded view of some of the components of the anti-pinch bolt of the invention shown in FIG. 4.
Figure 6:
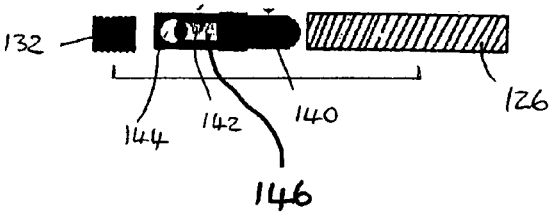
FIG. 6 is a partially exploded view of certain of the components of the anti-pinch bolt of the invention shown in FIG. 4.

Reference is now made to FIGS. 4, 5 and 6 of the drawings, which illustrate the various components of the anti-pinch bolt of the invention. The anti-pinch bolt 100 shown in FIG. 4 of the drawings is intended to have the capability to replace a bolt of the type shown in FIGS. 1 to 3 of the drawings, and, indeed, to replace any other conventional bolt in other paintball markers.

The bolt 100 of the invention comprises an elongate cylindrical body 102 having a front face 104, and a rear end 106. Towards the front face 104, there is located an inlet port 108. There may, if preferred, be more than one inlet port 108, which may be equispaced around the circumference of the body 102. In operation, compressed air in the paintball will pass through the aperture 54, and into the inlet ports 108. The air will then pass through passage 110, and exit the front face 104. A paintball 28 in front of the front face 104 will be propelled by the pneumatic force. O-rings 112 and 114 are located on the body 102 to provide the necessary seals and prevent air escaping other than out of the front face 104. Such O-rings will typically be used on an aluminum bolt, and other version may omit these O-rings.

The body 102 includes an elongate hollow core 118 extending from the rear end 106 to inside face 120. Opposing elongate slots 122 are formed within the wall of the body 102 on opposite sides thereof, with the hollow core 118 opening into each of the slots 122.

Within the hollow core 118, there is located a spring 126, a connector 128 and a pinhold 130. The spring 126, connector 128 and pinhold 130 are all inserted within the hollow core 118, and a threaded lug 132 engages the rear end 106 of the body 102, so that these three components are properly sealed within the hollow core 118.

A first end 134 of the spring 126 abuts against the inside face 120. The second end 136 engages the connector 128. The connector 128 comprises a central projection 138, a first cylindrical section 140, which is received within the spring 126, and a second cylindrical section 142, which is received within the pinhold 130. The pinhold 130 itself is a cylindrical member including a hole 144, to receive the push-pin as will be described, and a hollow portion 146 in communication with the pinhold 130, which receives the second cylindrical section 142 of the connector 128. In assembling the spring 126, connector 128 and pinhold 130 within the hollow core 118 of the bolt 100, it must be ensured that the hole 144 corresponds with the slots 122 in the body 102. Thus, in the assembled form, the bolt 100 will attach to the back block 38 by inserting a push-pin through a slot 122 on the one side, through the hole 144 of the pinhold 130, and then through the slot 122 on the opposing side of the body 102.

It should be noted that, in the assembled position, the push-pin will pass through the slots 122 and hole 144, and, due to the biasing action of the spring 126, the push-pin 160 will be located at the rear end 148 of the slot 122. The bolt 100 and the back block, such as 38, will thus move in unison with the push-pin 160 normally located at the rear end 148.

Figure 7:
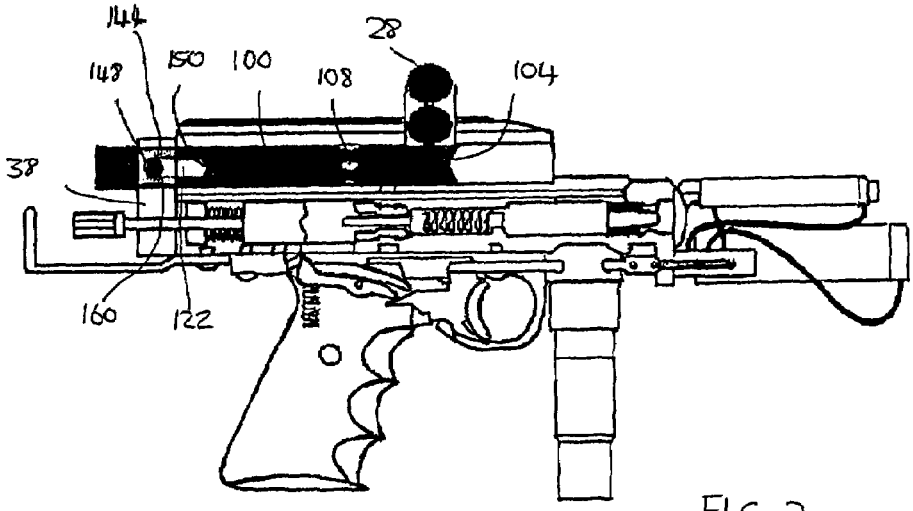
FIG. 7 is a side view, partly in section, of a paintball marker with an automatic cocking system, including the bolt of the invention, with the bolt shown in a first position.

In FIG. 7 of the drawings, an anti-pinch bolt 100 of the invention is shown inserted in the paintball marker 10 shown in the previous drawings. It is once again emphasized that the anti-pinch bolt 100 of the invention is not limited to use in a paintball marker of the type shown in FIGS. 1 to 3, but may be used in any appropriate paintball marker to achieve its defined purpose.

As will be discussed in further detail below with reference to FIGS. 7 to 10 of the drawings, the back block 38 and bolt 100 may operate somewhat independently of each other when an obstacle in the form of a paintball is detected in the barrel. The bolt 100 of the invention will be able to stop its forward movement when running into a jammed paintball. However, the back block will be able to continue its forward movement independently thereof. When the bolt 100 encounters a jammed paintball, it will stop. The back block 38 connected to the bolt 100 by the push-pin which passes through the hole 144 and slots 122 will, however, continue to move forward against the action of the spring 126. The hole 144 will therefore be moved by the push-pin 160 from the rear end 148 of the slot 122 towards the front end 150 of the slot 122. Thus, the forward movement of the block 38 will not move the bolt 100 forward, but will rather move in the slot 122 against the action of the spring 126.

It will, of course, be appreciated that the force of the spring 126 must be selected so that it falls within certain optimal tolerances. On the one hand, where there is no obstacle from a dislodged paint ball, the spring 126 should provide sufficient force to ensure that the bolt 100 and the back block 38 move together at all times. However, the force of the spring 126 should not be sufficiently high so that the bolt 100 will continue to move forward when a dislodged paint ball poses an obstacle. In other words, the bolt 100 and its components are designed to equalize the forward motion of the bolt with a spring system.

When a paintball 28 is thus pinched between the front face 104 of the bolt 100 and the body of the paintball marker 10, the bolt 100 stops moving forward by sliding on the pin 160 within the slots 122, which is cushioned by the spring. At the same time, however, the back block continues to its forward position. The bolt 100 is now pinching a paintball which is jammed, but not breaking it.

Figure 8:
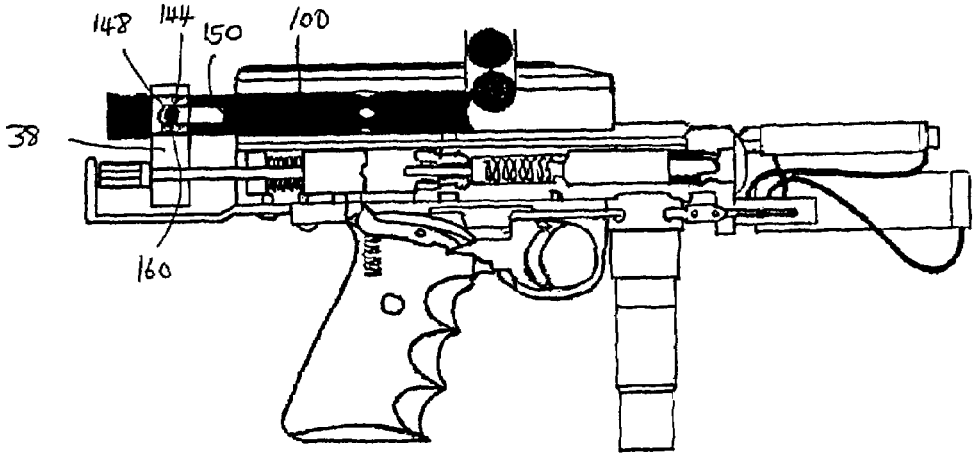
FIG. 8 is a side view, partly in section, of a paintball marker with an automatic cocking system shown in FIG. 7, with the bolt shown in a second position, wherein a paintball marker has not been properly dropped into the breech.

This action can clearly be seen in FIGS. 7 to 10 of the drawings, which will be briefly described. FIG. 7 shows the configuration where the bolt 100 is forward, and the feed port 30 is closed off. Paintballs 28 in the feed port are obstructed from further movement and from entering the body 12. In FIG. 8 of the drawings, the block 38 is moved rearwardly. The block 38 is connected to the bolt 100 by means of a pin 160. The pin 160 passes through the slots 122 and the hole 144. As the back block 38 moves rearwardly, its connection to the bolt 100 causes the bolt 100 to also move rearwardly. As the bolt moves rearwardly, a paintball 28 is seen dropping into the body.

Figure 9:
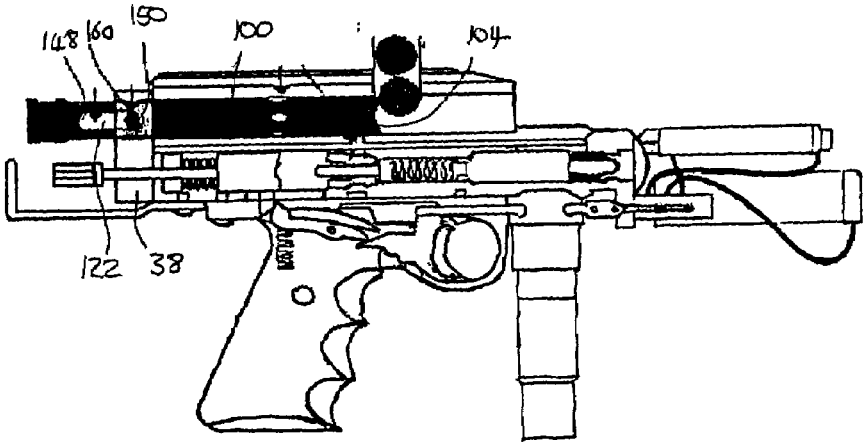
FIG. 9 shows the paintball marker with the anti-pinch bolt of the invention, as shown in FIG. 8, wherein the back block has moved forward, but the bolt has not.

In the situation shown in FIGS. 8 and 9, the paintball 28 has become jammed or lodged between the front face 104 of the bolt 100 and the wall of the feed port 30. The paintball 28 is therefore jammed and would, under normal conditions, be subsequently ruptured by the forward movement of the bolt 100. The forward movement of the bolt 100 would be concomitant with the forward movement of the back block 38. However, with the paintball jammed, the back block 38 continues to move forward, with the pinhold 130 and connecter 128 moving within the hollow core 118 against the action of the spring 126. Eventually, the pin 160 connecting the bolt 100 and the back block 38 moves from the rear end 148 of the slot 122 to the front end 150 thereof. In this way, the back block 38 continues to move, due to the pneumatic flow paths, but the bolt 100 is stalled in its position, due to the jammed paintball.

The flexible non-rigid connection between the back block 38 and the bolt 100 facilitates this function and operation to prevent rupture of the paintball. While the remainder of the paintball marker operation continues, the bolt 100 of the invention is able to discontinue its movement due to the obstacle.

Figure 10:
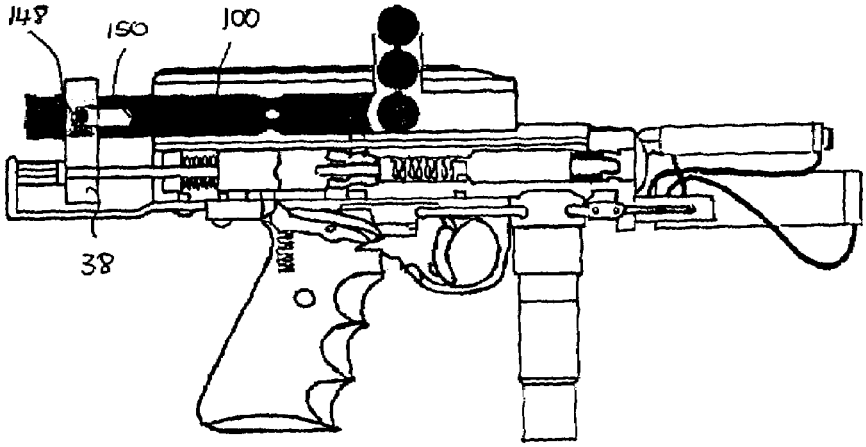
FIG. 10 is a view similar to FIG. 9, where the bolt has been pulled back, and the paintball allowed to drop into the breech.

In FIG. 10, it can be seen that the situation is then remedied by pulling the bolt 100 rearwardly, allowing the paintball to drop completely into the body, without obstruction, and therefore place it in a position for subsequent firing. Rupture of the paintball is therefore avoided, together with the concomitant disruption required for removal and cleaning of the paintball marker.

The bolt 100 of the invention is highly effective to prevent stoppage of a game due to failure of the trigger firing cycle. When a conventional bolt crushes a paintball, this usually means the end of the paintball game. Further, paintballs in the magazine or hopper, are often ruined. The bolt 100 of the invention, and its spring system, relieves the applied pressure of the pneumatics on the bolt 100, so that the paintballs are not crushed when jammed.

The present invention therefore allows continued operation of the paintball marker without disruption when a paintball is jammed. Normally, the pneumatic power source comprises a propellant in a cannister, the propellant being carbon dioxide, nitrogen, or compressed air. The air enters the front side of a ram which pushes the cocking rod and back block backwards approximately 1 inch, thus pulling the bolt and the cocking rod in one motion. In a subsequent cycle of the firing mechanism, the ram pulls the cocking block and bolt into the forward position so that the gun is ready to fire. These operations take place irrespective of the position of the paintball, since the system is unable to detect this. When the paintball is, therefore, not in the proper position, rupture takes place. However, the bolt of the invention is able to detect the obstacle's presence, and alter its motion accordingly to preserve the paintball and prevent rupture.

When the paintball is being pinched due to jamming by the bolt of the invention, the bolt will remain in its position until the trigger is pulled once more. Of course, the back block has moved to its forward position, at the same time compressing the spring 126, but not moving the bolt 100 beyond the point at which it will rupture the paintball. In order to clear the obstacle, the user may pull the trigger, which will fire the marker, but since the bolt is not completely forward, the appropriate air ports will not be aligned, and firing will not take place. However, the back block and the bolt will be moved to the rear, once more giving the paintball an opportunity to fall within the barrel. An alternative mechanism for correcting the jam is merely to grasp the rear end of the bolt, which extends externally of the marker, and pull it backward. This will allow the paintball to drop into the body. Either of these methods will clear the feed port and allow the paintball to fall completely into its desired position. The next time the trigger is pulled, the paintball will be normally expelled.

The invention is not limited to the precise details described herein. It will be appreciated that the particular mechanism whereby the back block is allowed to move forwardly without concomitant movement of the bolt may comprise any mechanism, and is not limited to the precise components described herein and illustrated in the drawings. In one variation, any mechanism which essentially keeps the push pin in a fixed position under normal circumstances, but allows flexibility in independent movement of the bolt 100 when a jam is detected, will fall within the scope of the invention.

The invention claimed is:

1. An anti-chop bolt for a paintball marker having an automatic reloading mechanism comprising an instrument connected to the bolt by a pin for moving the bolt between a loading and a loaded position, the bolt comprising;

a tubular bolt body having a front end, a rear end and a slot for receiving the pin;

a pinhold in the tubular bolt body for engaging the pin; and biasing means for maintaining the pinhold in a first position relative to the slot, the biasing means allowing movement of the pinhold toward a second position in the slot when the bolt is obstructed by the presence of a paintball.

2. An a anti-chop bolt as claimed in claim 1 wherein the tubular bolt body comprises a hollow core extending from the rear end thereof axially into the tubular body, a pair of slots in communication with the hollow core, and a plug member for closing off the hollow core at the rear end thereof.

3. An anti-chop bolt as claimed in claim 2 wherein the biasing means comprises a spring located within the hollow core.

4. An anti-chop bolt as claimed in claim 3 further comprising a pinhold for receiving the pin, the pinhold being urged by the spring toward the first position.

5. An anti-chop bolt as claimed in claim 4 further comprising a connector located between the spring and the pin hold to facilitate alignment and operation thereof.

6. An anti-chop bolt as claimed in claim 4 wherein the pinhold comprises a cylindrical member having an aperture therein for receiving the pin, the aperture in use being aligned with the slot on the tubular bolt body.

7. An anti-chop bolt as claimed in claim 5 wherein the pinhold comprises a cylindrical member having an aperture therein for receiving the pin, the aperture in use being aligned with the slot on the tubular bolt body, and a hollow portion for receiving at least a part of the connector.

8. An anti-chop bolt as claimed in claim 5 wherein the connector comprises a circular central portion, a first lateral cylindrical portion at least a part of which engages with the pin hold, and a second lateral cylindrical portion which is received within the spring.

9. An h anti-chop bolt as claimed in claim 3 wherein the spring is selected so as to have a biasing force to equalize the pressure of the forward motion of the bolt.

10. An anti-chop bolt as claimed in claim 3 wherein the spring is selected so that it will allow movement of the pin within the slot when the force required to rupture a paint ball is greater than the force of the spring.

11. An anti-chop bolt as claimed in claim 1 having a face at the front end, a passage extending from the front end rearwardly into the tubular bolt body, and a plurality of air inlet apertures about the circumference of the bolt body whereby air under pressure is forced through the holes, into the passage, and out through the front face of the tubular body.

12. An anti-chop bolt comprising:

a tubular bolt body having a front end, a rear end and a slot for receiving a pin; and biasing means associated with a pinhold member in the tubular bolt body for maintaining, in use, the pin in a first position in the slot, the biasing means allowing movement of the pin towards a second position in the slot so that, in use, an obstruction to movement of the bolt allows the pin to move between the first and second positions without movement of the bolt.

13. An anti-chop bolt as claimed in claim 12 wherein the tubular bolt body comprises a hollow core extending from the rear end thereof axially into the tubular body, a pair of slots in communication with the hollow core, and a plug member for closing off the hollow core at the rear end thereof.

14. An anti-chop bolt as claimed in claim 13 wherein the biasing means comprises a spring located within the hollow core.

15. An anti-chop bolt as claimed in claim 14 further comprising a pinhold for receiving the pin, the pinhold being urged by the spring toward the first position.

16. An anti-chop bolt as claimed in claim 15 further comprising a connector located between the spring and the pin hold to facilitate alignment and operation thereof.

17. An anti-chop bolt as claimed in claim 16 wherein the pinhold comprises a cylindrical member having an aperture therein for receiving the pin, the aperture in use being aligned with the slot on the tubular bolt body.

18. An anti-chop bolt as claimed in claim 17 wherein the pinhold comprises a cylindrical member having an aperture therein for receiving the pin, the aperture in use being aligned with the slot on the tubular bolt body, and a hollow portion for receiving at least a part of the connector.

19. An anti-chop bolt as claimed in claim 17 wherein the connector comprises a circular central portion, a first lateral cylindrical portion at least a part of which engages with the pinhold, and a second lateral cylindrical portion which is received within the spring.

20. An anti-chop bolt as claimed in claim 13 wherein the spring is selected so that it will allow movement of the pin within the slot when the force required to rupture a paint ball is greater than the force of the spring.

21. An paintball marker having an anti-chop bolt, the paintball marker having an automatic reloading mechanism comprising an instrument connected to the bolt by a pin for moving the bolt between a loading and a loaded position, the bolt comprising: a tubular bolt body having a front end, a rear end and a slot for receiving the pin; and biasing means for maintaining, in use, the pin in a first position in the slot, the biasing means allowing movement of the pin toward a second position in the slot when the bolt is obstructed by the presence of a paintball.

22. An anti-chop bolt for use with a paintball marker having an automatic reloading mechanism comprising an instrument connected to the bolt by a pin for moving the bolt between a loading and a loaded position, the bolt comprising:

a tubular bolt body having a front end, a rear end and a slot for receiving the pin; and biasing means for maintaining, in use, the pin in a first position in the slot, the biasing means allowing movement of the pin toward a second position in the slot when the bolt is obstructed by the presence of a paintball.

* * * * *